US006386075B1

(12) United States Patent
Shiao

(10) Patent No.: US 6,386,075 B1
(45) Date of Patent: May 14, 2002

(54) SWINGABLE HANDLE ADAPTED FOR ROTATING A TOOL BIT OF A HAND TOOL

(76) Inventor: Hsuan-Sen Shiao, No. 15-1, Lane 369, Min-Chuan Rd., Taichung City (TW)

( * ) Notice: Subject to any disclaimer, the term of this patent is extended or adjusted under 35 U.S.C. 154(b) by 0 days.

(21) Appl. No.: 09/848,027

(22) Filed: May 3, 2001

(51) Int. Cl.[7] ..... B25B 23/16
(52) U.S. Cl. ..... 81/177.8; 81/177.7; 16/438
(58) Field of Search ..... 81/177.8, 177.9, 81/177.7; 16/438, 111.1

(56) References Cited

U.S. PATENT DOCUMENTS 4,825,734 A * 5/1989 Schwalbe et al. ..... 81/177.7
5,069,091 A * 12/1991 Bramsiepe et al. ..... 81/177.9
5,280,738 A * 1/1994 Liou ..... 81/177.9
5,329,834 A * 7/1994 Wong ..... 81/177.4
5,515,754 A * 5/1996 Elkins ..... 81/177.7
5,816,119 A * 10/1998 Herue ..... 81/177.8
5,943,925 A * 8/1999 Huang ..... 81/177.8
6,145,413 A * 11/2000 Lin ..... 81/177.7
6,189,420 B1 * 2/2001 Shiao ..... 81/177.8

* cited by examiner

*Primary Examiner*—James G. Smith
*Assistant Examiner*—Hadi Shakeri

(57) ABSTRACT

A swingable handle is adapted to deliver torque for rotating a tool bit of a hand tool, and includes front and rear handle bodies pivoted to each other. A first mating wall of the front handle body mates with and is turnable relative to a second mating wall of a spring-biased coupling member which is movable longitudinally relative to the rear handle body. A retaining member is disposed between the first and second mating walls to restrain the first mating wall from rotation relative to the second mating wall. The coupling member has a shifted portion with a relatively large actuating wall surface so as to be conveniently actuated to move the second mating wall away from the first mating wall.

8 Claims, 7 Drawing Sheets

SWINGABLE HANDLE ADAPTED FOR ROTATING A TOOL BIT OF A HAND TOOL

BACKGROUND OF THE INVENTION

1. Field of the Invention

This invention relates to a hand tool, more particularly to a swingable handle for use to deliver increased torque to rotate a tool bit of a hand tool.

2. Description of the Related Art

Referring to FIG. 1, a conventional handle of a hand tool, such as that disclosed in U.S. Pat. No. 6,189,420, is shown to include a rear handle body 1 which is pivoted to a front handle body 2 by a pivot pin 4 that passes through holes 102, 202 in the front and rear handle bodies 2,1. Three retaining concavities 203 are formed in the front handle body 2 for receiving three spring-biased retainers 3, respectively. A hole 103 is formed in the rear handle body 1 such that one of the retainer 3 can be retained in the hole 103 for arresting the rotation of the front handle body 2 relative to the rear handle body 1. The retainer 3 which is retained in the hole 103 can be pressed inwardly to permit rotation of the front handle body 2. However, the operation of the retainer 3, which has a relatively small surface, is not comfortable for the user.

Referring to FIG. 2, another conventional handle of a hand tool is shown to include a rear handle body 1' with a pivot hole 101', and a front handle body 2' with an elongate pivot hole 201'. A pivot pin 3' passes through the pivot holes 101', 201' to connect pivotally the rear handle body 1' to the front handle body 2'. The front and rear handle bodies 1', 2' have mating walls which are disposed to mate with each other and which respectively have a retaining protrusion 102' and a retaining groove 202' that engage each other to restrain the front handle body 2' from movement relative to the rear handle body 1'. When the front handle body 2' is pressed forward to disengage the protrusion 102' from the groove 202', the rear handle body 1' can rotate relative to the front handle body 2' to adjust torque for rotating a tool bit mounted on the front handle body 2'. However, no device is provided for retaining the rear handle body 1' at an angle relative to the front handle body 2'. In addition, a clearance is formed between the mating walls in the angular position of the handle bodies 1',2', thereby exposing the user's hand to the risk of injury.

SUMMARY OF THE INVENTION

The object of the present invention is to provide a swingable handle which can be operated conveniently and comfortably to swing a rear handle body relative to a front handle body, which can restrain firmly the rear handle body from rotation relative to the front handle body, and which has a simple and compact construction that can lead to a reduced packaging size.

According to this invention, the swingable handle includes a rear handle body which has a front end wall facing forward, a rear end wall that is disposed opposite to the front end wall in a longitudinal direction parallel to a rotation axis of a tool-bit, and an outer surrounding wall that is disposed between the front and rear end walls. The front end wall has an accommodating cavity which extends toward the rear end wall in the longitudinal direction and which is surrounded by the outer surrounding wall. The outer surrounding wall has an inner peripheral edge portion to define a guiding slot which extends inwardly and in a radial direction relative to the rotation axis to communicate with the accommodating cavity. A front handle body has a mount end portion which is adapted to connect with a tool shaft for holding the tool bit, and a coupling end portion opposite to the mount end portion in the longitudinal direction. The coupling end portion is pivoted to the front end wall about a pivot axis transverse to the rotation axis. The coupling end portion has a first mating wall which extends in a transverse direction parallel to the pivot axis, which confronts the front end wall, and which is distal to the mount end portion relative to the pivot axis. A coupling member is mounted in and is movable relative to the accommodating cavity in the longitudinal direction. The coupling member includes a second mating wall which extends in the transverse direction and which confronts and mates with the first mating wall such that when the front end wall is turned about the pivot axis, the second mating wall is moved angularly relative to the first mating wall. The coupling member further includes a shifted portion which is fitted in and which is movable relative to the guiding slot in the longitudinal direction such that the second mating wall is moved by the shifted portion away from the first mating wall. A biasing member is disposed to bias the second mating wall toward the first mating wall in the longitudinal direction. A retaining member is disposed between the first and second mating walls such that when the second mating wall is biased to move toward the first mating wall, the retaining member prevents the first mating wall from moving angularly relative to the second mating wall, and such that when the second mating wall is moved by the shifted portion away from the first mating wall against biasing action of the biasing member, the second mating wall is angularly movable relative to the first mating wall between an in-line position, where the mount end portion is in-line with the rear handle body, and an angular position, where the rear handle body forms an angle with the rotation axis.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
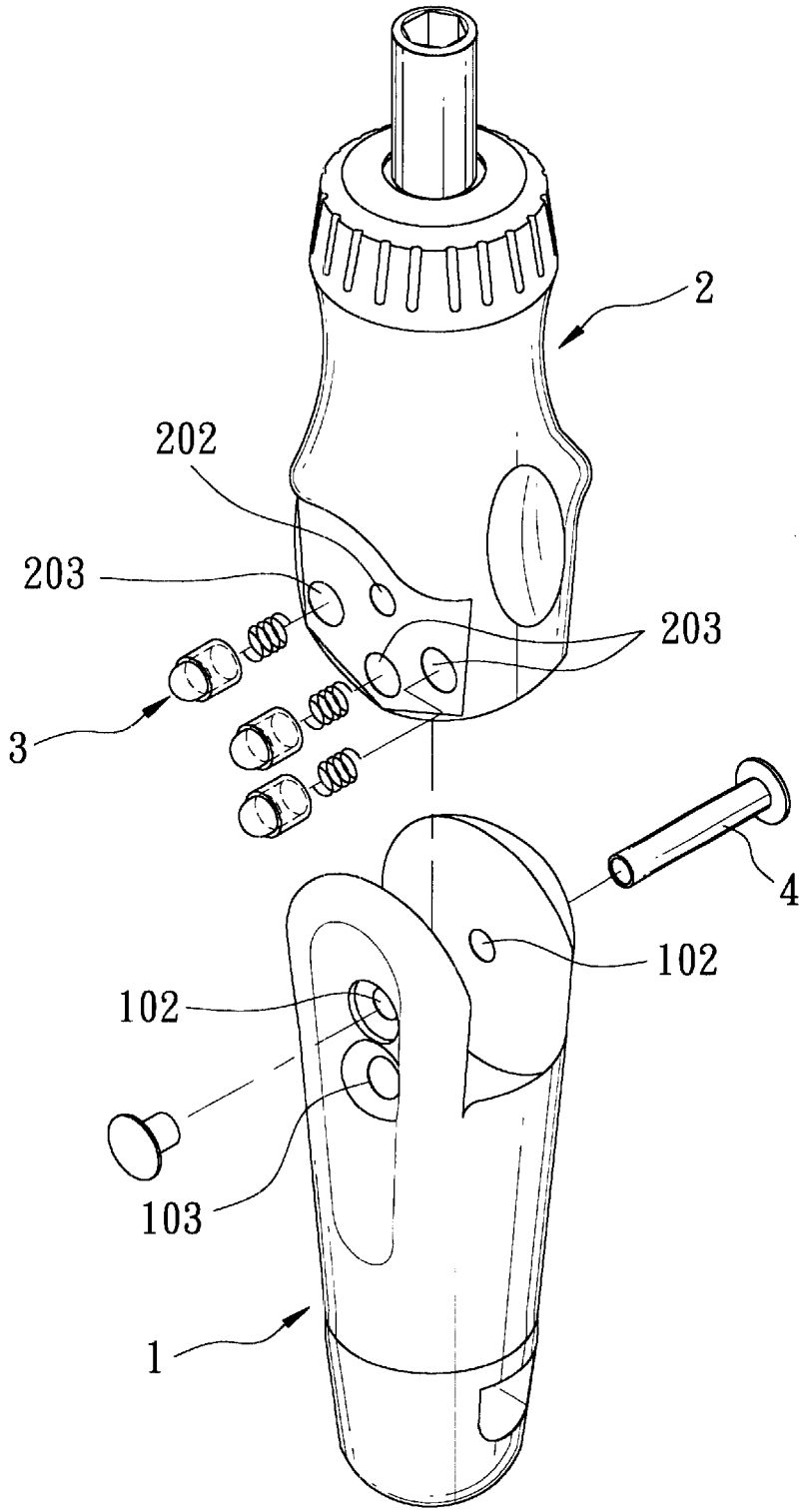
FIG. 1 PRIOR ART
FIG. 1 is an exploded perspective view of a conventional handle of a hand tool.
Figure 2:
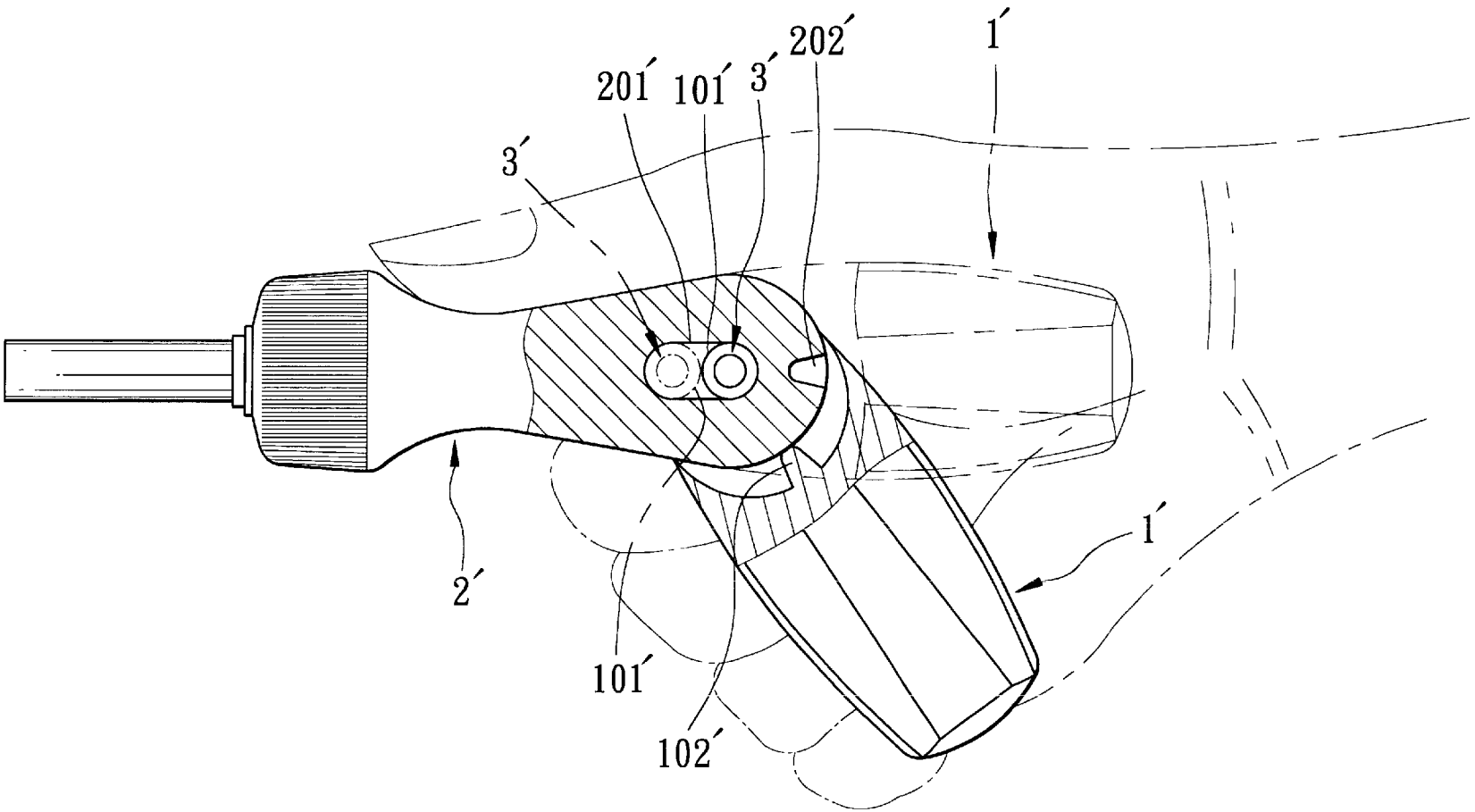
FIG. 2 PRIOR ART
FIG. 2 is a sectional view of another conventional handle of a hand tool in a state of use.
Figure 3:
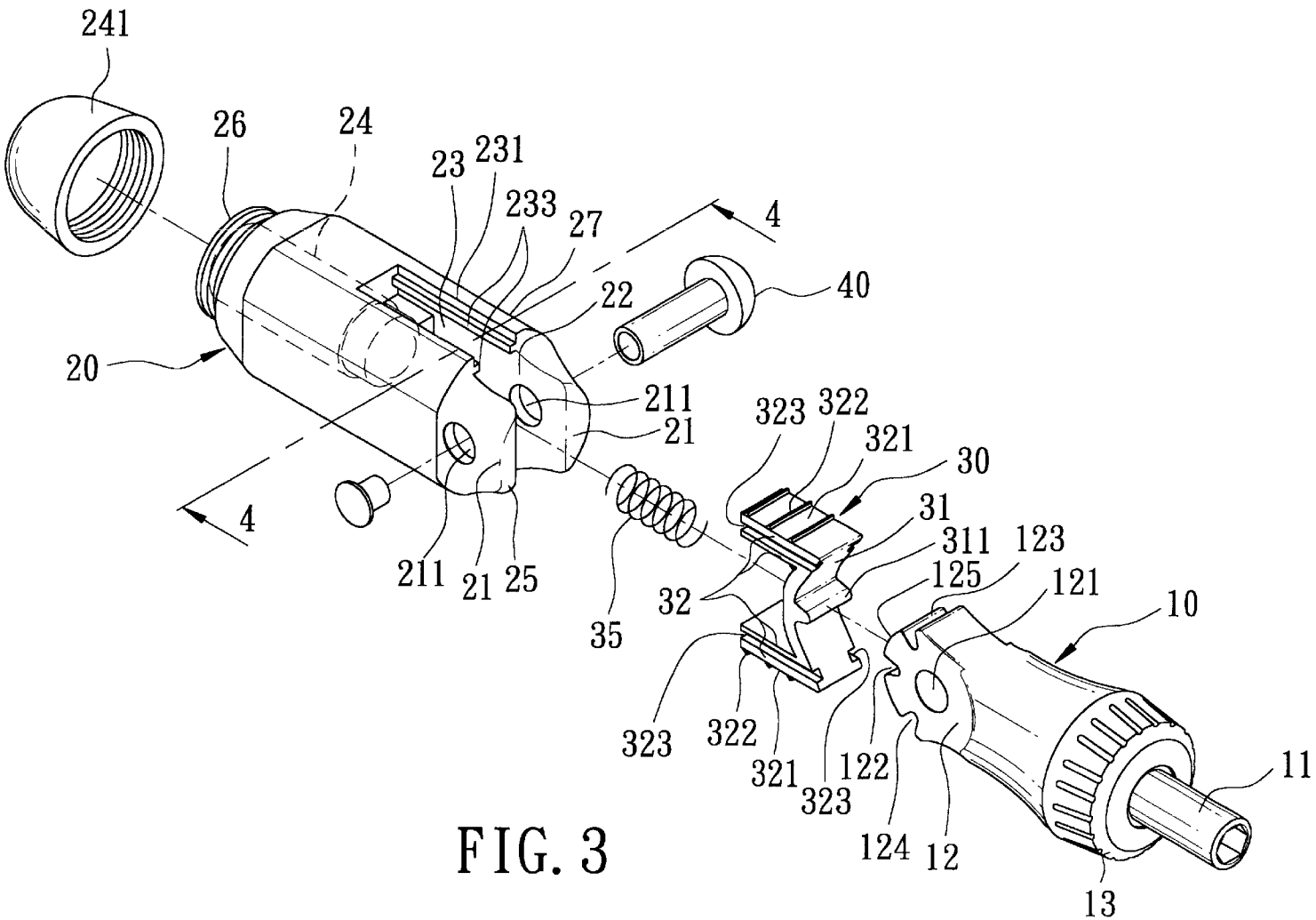
FIG. 3 is an exploded perspective view of a preferred embodiment of a swingable handle according to this invention.
Figure 4:
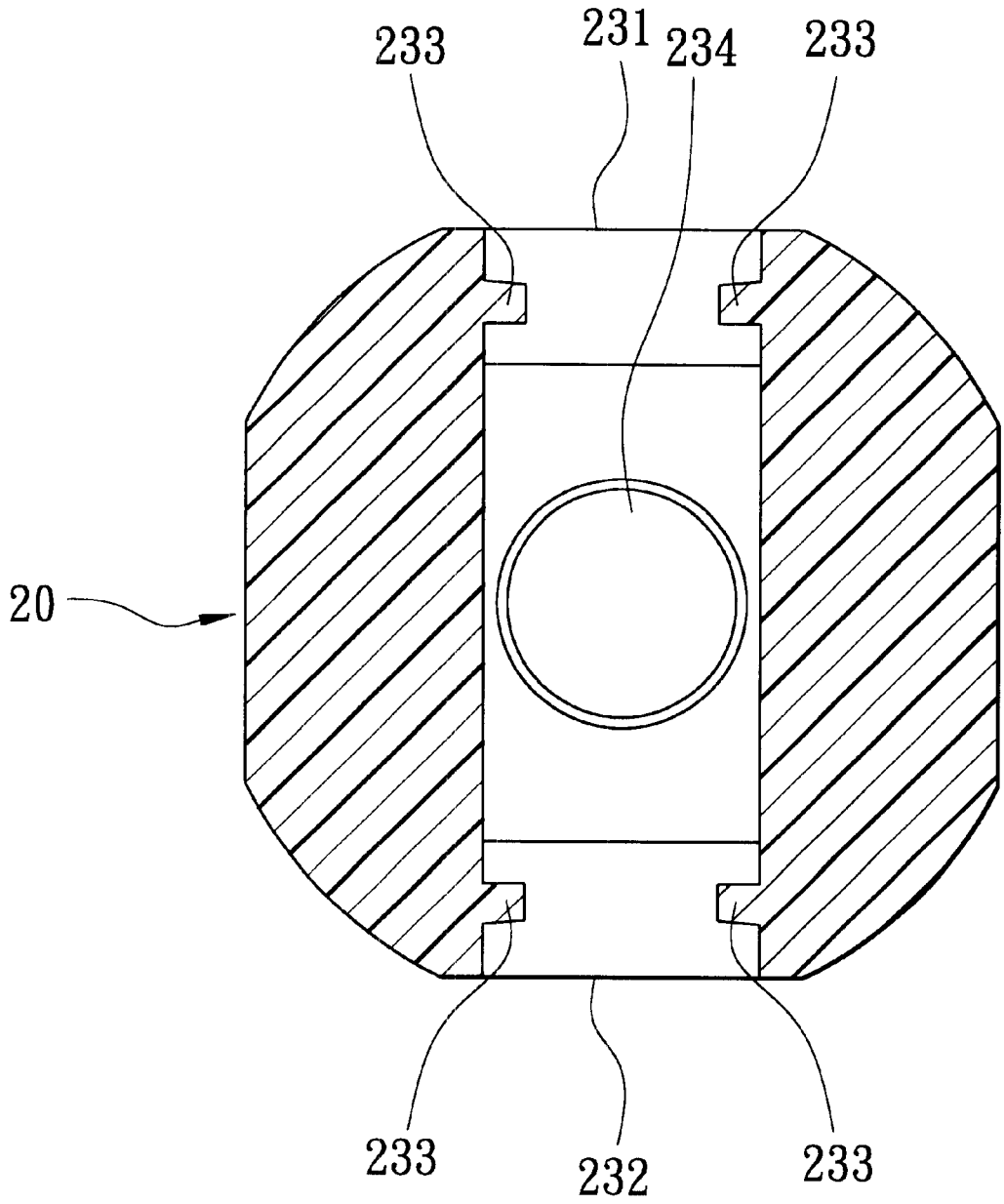
FIG. 4 is a partly cross-sectional view of the front handle body of the preferred embodiment, taken along lines 4—4 of FIG. 3.
Figure 5:
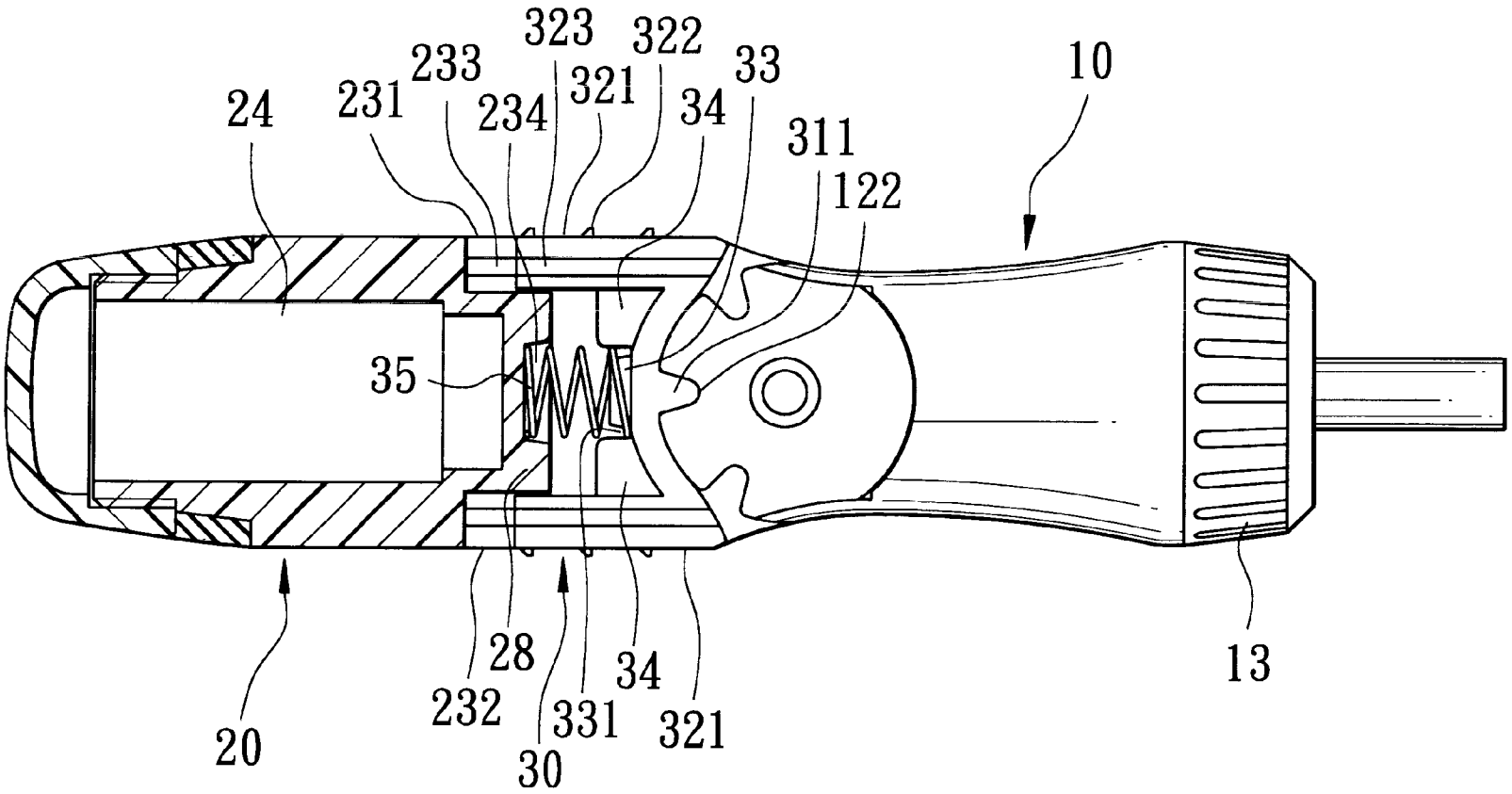
FIG. 5 is a sectional view of the preferred embodiment in an in-line state.

Referring to FIGS. 3, 4 and 5, the preferred embodiment of the swingable handle according to the present invention is adapted to be used for delivering increased torque to rotate a tool bit (not shown) of a hand tool about a rotation axis, and is shown to comprise a rear handle body 20, a front handle body 10, and a coupling member 30.

The rear handle body 20 has a front end wall 25 facing forward, a rear end wall 26 which is disposed opposite to the front end wall 25 in a longitudinal direction parallel to the rotation axis, and an outer surrounding wall 27 which is disposed between the front and rear end walls 25,26. The front end wall 25 has an accommodating cavity 23 which extends toward the rear end wall 26 in the longitudinal direction and which is surrounded by the outer surrounding wall 27 so as to divide the front end wall 25 into two opposite fins 21 with holes 211. The outer surrounding wall 27 has upper and lower inner peripheral edge portions 231,232 that define upper and lower guiding slots which extend inwardly and in a radial direction relative to the rotation axis to communicate with the accommodating cavity 23. Each of the upper and lower inner peripheral edge portions 231,232 is formed with a pair of keys 233 which extend in the longitudinal direction and which are disposed opposite to each other in a transverse direction relative to the longitudinal direction. In addition, an inner end wall 28 borders the accommodating cavity 23 and is spaced apart from the front end wall 25 in the longitudinal direction. The inner end wall 28 has a recess 234 which extends toward the rear end wall 26. Moreover, the rear end wall 26 has a tool-bit receiving chamber 24 which extends toward the inner end wall 28 in the longitudinal direction and which is adapted for receiving tool bits. The receiving chamber 24 is cover by a cap member 241 which engages threadedly the rear end wall 26.

The front handle body 10 has a mount end portion 13 which is adapted to connect with a tool shaft 11 for holding the tool bit, and a coupling end portion 12 opposite to the mount end portion 13 in the longitudinal direction. The coupling end portion 12 is inserted into a space 22 between the fins 21, and has a pivot hole 121 for pivoting to the front end wall 25 about a pivot axis in the transverse direction via a pivot pin 40 which passes through the pivot hole 121 and the holes 211. The coupling end portion 12 has a first mating wall 125 which extends in a transverse direction parallel to the pivot axis and which has a convex surface facing rearward. Three retaining grooves 122,123,124 are formed in the convex surface and are angularly spaced apart from each other about the pivot axis. The rotation axis passes through the retaining groove 122.

The coupling member 30 is mounted in and is movable relative to the accommodating cavity 23 in the longitudinal direction, and includes a second mating wall 31 which is disposed to extend in the transverse direction and which has a concave surface that confronts and that mates with the convex surface of the first mating wall 125. A retaining protrusion 311 is disposed on and projects forwardly from the concave surface of the second mating wall 31, and extends in the transverse direction so as to be retained in a selected one of the retaining grooves 122,123,124 when the second mating wall 31 is biased to move toward the first mating wall 125. With reference to FIG. 5, the second mating wall 31 further has a stem 33 which projects rearwardly therefrom and opposite to the concave surface, and upper and lower ribs 34 which are disposed on two opposite sides of the stem 33 and which cooperate with the stem 33 to confine a clearance 331 therebetween. A shifted portion 32 is connected to the second mating wall 31, and includes upper and lower operating walls 321 which are fitted in the upper and lower guiding slots of the upper and lower inner peripheral edge portions 231,232. Each of the upper and lower operating walls 321 has a pair of keyways 323 which extend in the longitudinal direction and which are disposed opposite to each other in the transverse direction so as to be slidable retainingly on and relative to the keys 233. Each of the upper and lower operating walls 321 further has an actuating wall surface which extends above the keyways 323 and outwardly of the respective guiding slot so as to be actuated externally, and a plurality of slip-preventing ribs 322 which are formed on the actuating wall surface. A biasing member 35, such as a compression spring, has an end portion which is received in the recess 234, and an opposite end portion which is received retainingly in the clearance 331 and which abuts against the second mating wall 31 so as to bias the second mating wall 31 toward the first mating wall 125 in the longitudinal direction.

Figure 6:
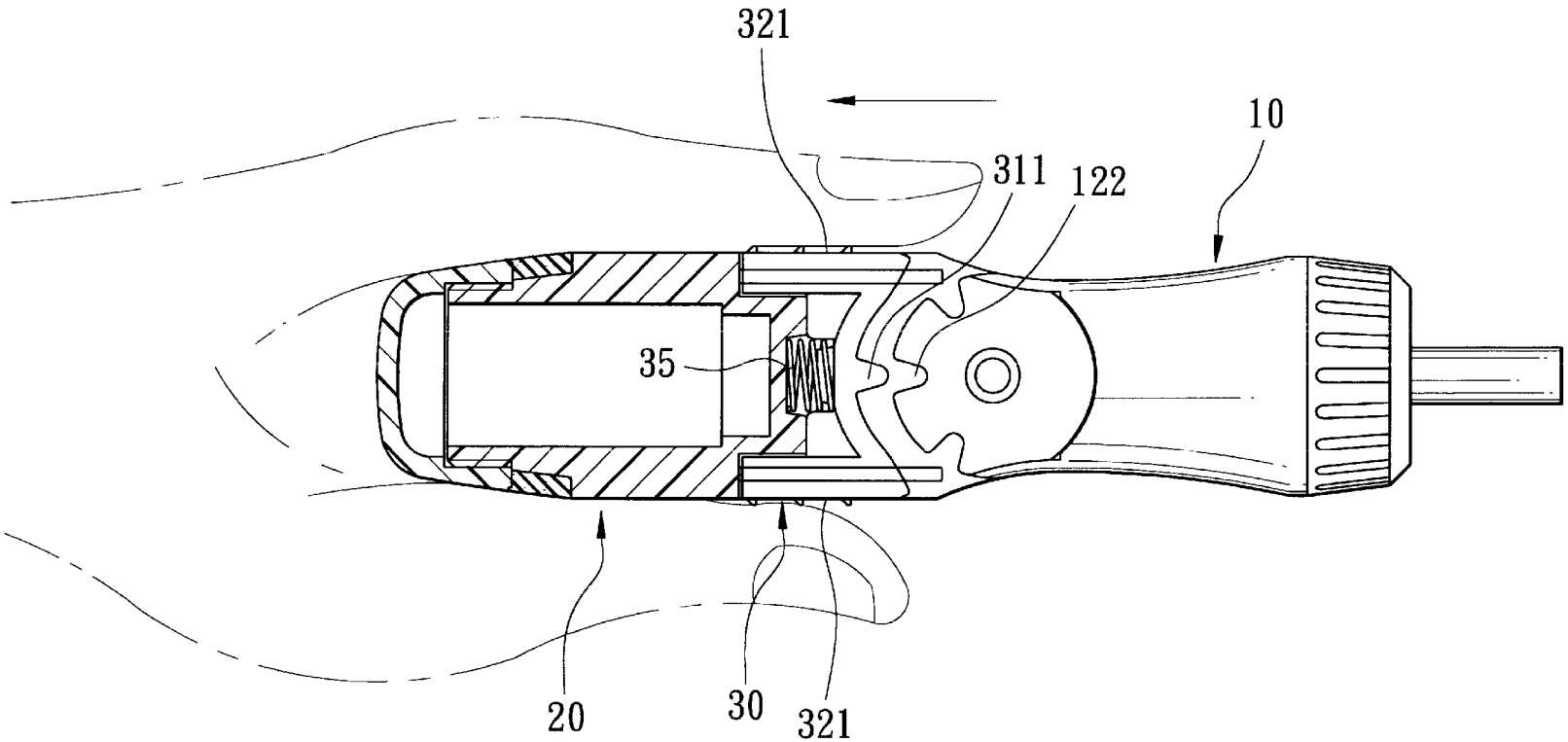
FIG. 6 is a sectional view showing the preferred embodiment in an operated state.
Figure 7:
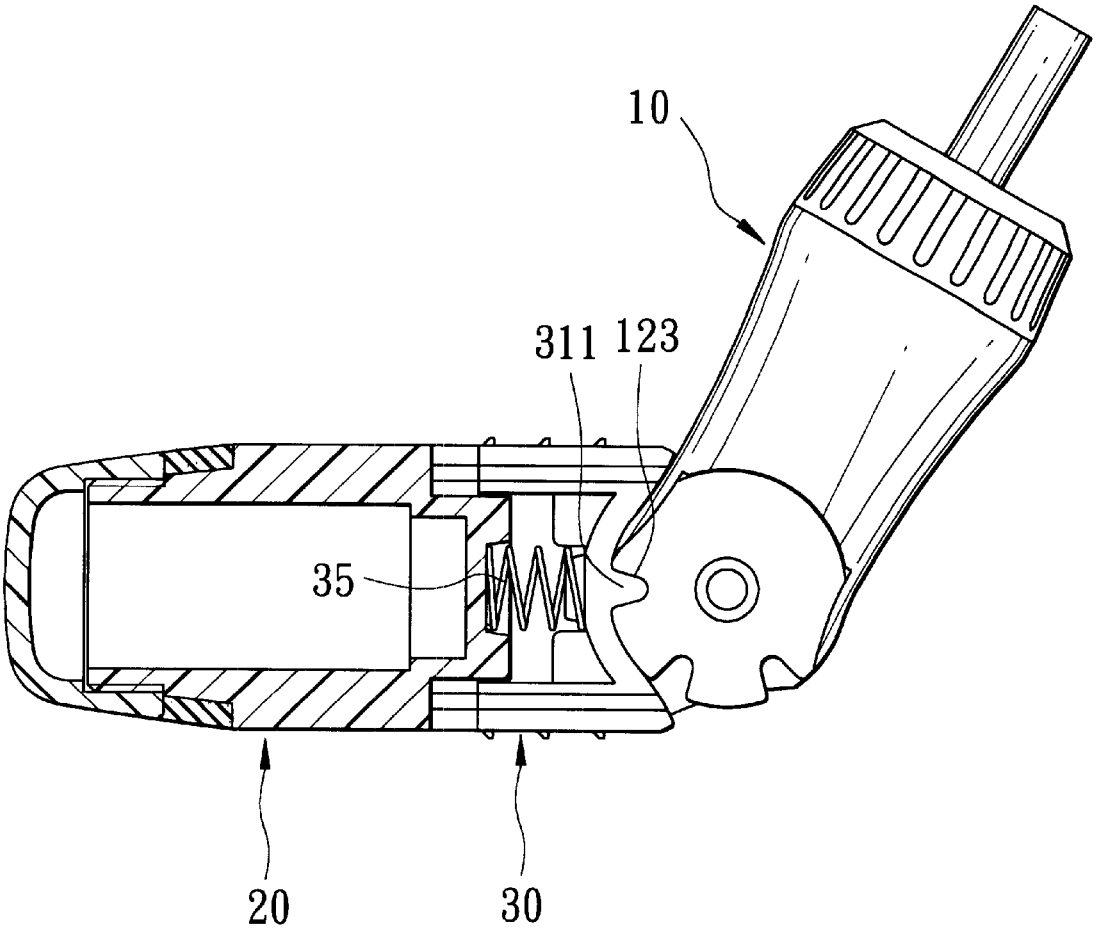
FIG. 7 is a sectional view of the preferred embodiment in an angular state.

As illustrated, when the second mating wall 31 is biased to move toward the first mating wall 125, the retaining protrusion 311 is retained in one of the retaining grooves 122 to prevent the first mating wall 125 from moving angularly relative to the second mating wall 31 to form an in-line state, where the mount end portion 13 is in-line with the rear handle body 20, as shown in FIG. 5. Referring to FIG. 6, when the user moves the operating walls 321 as well as the second mating wall 31 rearwardly away from the first mating wall 125 against biasing action of the biasing member 35 to disengage the protrusion 311 from the groove 122, the first mating wall 125 is angularly movable relative to the second mating wall 31. Then, the second mating wall 31 is moved toward the first mating wall 125 such that the protrusion 311 engages another one of the grooves 123 due to the biasing action of the biasing member 35, so as to form an angular state, where the rear handle body 20 forms an angle with the rotation axis, as shown in FIG. 7.

By means of the first and second mating walls 125,31 with the mating and fitting convex and concave surfaces, a clearance will not be formed during rotation of the front handle body 10 relative to the rear handle body 20. In addition, the retaining protrusion 311 extends in the transverse direction so as to be retained firmly in one of the retaining grooves. 122,123,124. The operating walls 321 have the actuating wall surfaces with a relatively large area to provide a comfortable feeling for the user during operation. While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A swingable handle for delivering torque to rotate a tool bit of a hand tool about a rotation axis, said handle comprising:

a rear handle body having a front end wall facing forward toward the tool bit, a rear end wall disposed opposite to said front end wall in a longitudinal direction parallel to the rotation axis, and an outer surrounding wall disposed between said front and rear end walls, said front end wall having an accommodating cavity which extends toward said rear end wall in the longitudinal direction and which is surrounded by said outer surrounding wall, said outer surrounding wall having an inner peripheral edge portion to define a guiding slot which extends inwardly and in a radial direction relative to the rotation axis to communicate with said accommodating cavity;

a front handle body having a mount end portion adapted to connect with a tool shaft for holding the tool bit, and a coupling end portion opposite to said mount end portion in the longitudinal direction, said coupling end portion being pivoted to said front end wall about a pivot axis transverse to the rotation axis, said coupling end portion having a first mating wall which extends in a transverse direction parallel to the pivot axis, which confronts said front end wall, and which is distal to said mount end portion relative to the pivot axis;

a coupling member mounted in and movable relative to said accommodating cavity in the longitudinal direction, and including a second mating wall which is disposed to extend in the transverse direction and to confront and mate with said first mating wall such that when said front end wall is turned about the pivot axis, said first and second mating walls being angularly movable relative to each other, said coupling member further including a shifted portion which is disposed to be fitted in and to be movable relative to said guiding slot in the longitudinal direction such that said second mating wall is moved by said shifted portion away from said first mating wall;

a biasing member disposed to bias said second mating wall toward said first mating wall in the longitudinal direction; and retaining means disposed between said first and second mating walls such that when said second mating wall is biased to move toward said first mating wall, said retaining means prevents said first mating wall from moving angularly relative to said second mating wall, and such that when said second mating wall is moved by said shifted portion away from said first mating wall against biasing action of said biasing member, said second mating wall is angularly movable relative to said first mating wall between an in-line position, where said mount end portion is in-line with said rear handle body, and an angular position, where said rear handle body forms an angle with the rotation axis.

2. The swingable handle of claim 1, wherein said first and second mating walls respectively have convex and concave surfaces which are fitted to and which mate with each other.

3. The swingable handle of claim 2, wherein said retaining means includes a plurality of retaining grooves formed in said convex surface and angularly spaced apart from each other about the pivot axis, and a retaining protrusion projecting forwardly from said concave surface and extending in the transverse direction so as to be retained in a selected one of said retaining grooves when said second mating wall is biased to move toward said first mating wall.

4. The swingable handle of claim 3, wherein said rear handle body further has an inner end wall which borders said accommodating cavity, and which is spaced apart from said front end wall in the longitudinal direction, said inner end wall having a recess which extends towards said rear end wall, said second mating wall having a stem which projects rearwardly therefrom and opposite to said concave surface, said biasing member being a compression spring which has an end portion that is received in said recess and an opposite end portion that is sleeved on said stem and that abuts against said second mating wall so as to bias said second mating wall away from said inner end wall.

5. The swingable handle of claim 1, wherein said inner peripheral edge portion is formed with a key which extends in the longitudinal direction, said shifted portion being formed with a keyway which extends in the longitudinal direction so as to be retainingly slidable relative to said key.

6. The swingable handle of claim 5, wherein said shifted portion has an actuating wall surface which extends above said keyway and outwardly of said guiding slot so as to be actuated externally, and a plurality of slip-preventing ribs which are formed on said actuating wall surface.

7. The swingable handle of claim 1, wherein said rear end wall has a tool-bit receiving chamber which extends toward said front end wall in the longitudinal direction.

8. The swingable handle of claim 7, further comprising a cap member for covering said receiving chamber.

* * * * *